US010429160B2

(12) United States Patent
Erickson et al.

(10) Patent No.: US 10,429,160 B2
(45) Date of Patent: Oct. 1, 2019

(54) FIRE-RETARDING ARTILLERY SHELL

(71) Applicant: THE BOEING COMPANY, Chicago, IL (US)

(72) Inventors: Todd W. Erickson, Fife, WA (US); Sina Golshany, Lynnwood, WA (US); Shelly A. Songstad, Everett, WA (US); Adriana W. Blom, Shoreline, WA (US); Jacqueline A. Artis, Boise, ID (US); Christopher R. Holtorf, Marysville, WA (US); Natalie Daughtry, Mountlake Terrace, WA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 15/785,906

(22) Filed: Oct. 17, 2017

(65) Prior Publication Data

US 2018/0128585 A1 May 10, 2018

Related U.S. Application Data

(63) Continuation of application No. 14/180,307, filed on Feb. 13, 2014, now Pat. No. 9,816,791.

(51) Int. Cl.

| | |
|---|---|
| ***F42B 12/50*** | (2006.01) |
| ***F42C 19/08*** | (2006.01) |
| ***A62C 3/02*** | (2006.01) |

(52) U.S. Cl.

CPC ..... *F42B 12/50* (2013.01); *A62C 3/025* (2013.01); *A62C 3/0228* (2013.01); *F42C 19/0838* (2013.01)

(58) Field of Classification Search

CPC ..... F42B 12/50; A62C 3/0028; A62C 3/025; F42C 19/0838

USPC ..... 102/499; 169/36

See application file for complete search history.

(56) References Cited

U.S. PATENT DOCUMENTS

| | | | | |
|---|---|---|---|---|
| 1,481,930 | A | 1/1924 | Schneider | |
| 1,825,517 | A | 9/1931 | Gardner | |
| 2,041,253 | A * | 5/1936 | Leussler | F42B 5/26 102/464 |
| 2,091,635 | A | 8/1937 | Hayden | |
| 2,321,344 | A * | 6/1943 | Whipple | F42B 12/34 102/509 |
| 3,003,420 | A | 10/1961 | Nosler | |
| 3,980,139 | A | 9/1976 | Kirk | |
| 5,330,105 | A * | 7/1994 | Kaylor | A62C 31/12 137/889 |
| 6,732,725 | B2 | 5/2004 | Doud | |
| 6,772,694 | B1 | 8/2004 | Pearce, III et al. | |
| 7,083,000 | B2 | 8/2006 | Edwards et al. | |
| 7,090,029 | B2 | 8/2006 | Cleary et al. | |
| 7,325,350 | B1 * | 2/2008 | Grimes | A62C 17/00 102/370 |
| 8,746,355 | B2 | 6/2014 | Demmitt | |
| 2008/0202324 | A1 | 8/2008 | Steele | |
| 2010/0230120 | A1 | 9/2010 | Silverstein | |

* cited by examiner

*Primary Examiner* — Samir Abdosh

(74) *Attorney, Agent, or Firm* — Patterson+ Sheridan, LLP

(57) ABSTRACT

An artillery shell is fired out of a gun towards a fire. A trigger releases a fire-retarding material from the artillery shell to retard the fire.

20 Claims, 7 Drawing Sheets

FIRE-RETARDING ARTILLERY SHELL

CROSS-REFERENCE TO RELATED APPLICATIONS

This application is a continuation of co-pending U.S. patent application Ser. No. 14/180,307, filed Feb. 13, 2014, now issued as U.S. Pat. No. 9,816,791. The aforementioned related patent application is herein incorporated by reference in its entirety.

FIELD OF THE DISCLOSURE

This disclosure relates to fire-retarding artillery shell and to methods of firing the artillery shell from a gun to retard a fire.

BACKGROUND

Forest fires differ from other fires by their extensive size, the speed at which they can spread out from their original source, and their potential to change direction unexpectedly. To retard forest fires, fire-retarding material is typically dropped into or in front of the advancing fire from aircraft such as helicopters or airplanes. Such aircraft deliver fire-retarding material at a low rate which often makes them inadequate to control forest fires. For instance, Applicant has determined (based on the National Wildfire Coordinating Group (NWCG) Incident Response Pocket Guide), that in order to establish an aircraft-delivered firebreak for a relatively small 28 acre fire, it would take approximately 7.6 hours to deliver a required 6,469 gallons of fire-retarding material. During the 7.6 hour time period, the relatively small 28 acre fire has potential to grow and burn an estimated 100 acres of land.

The weaknesses of aircraft-delivered firebreaks are further exposed when combating larger fires. For example, in order to establish an aircraft-delivered firebreak for a relatively large 883 acre fire, Applicant has determined (based on the NWCG Incident Response Pocket Guide), that it would take approximately 34.3 hours to deliver a required 360,000 gallons of fire-retarding material. During the 34.3 hour time period, the relatively large 883 acre fire has potential to grow and burn an estimated 3,130 acres of land.

Whether it's a small or large fire, the shortcomings of aircraft-delivered firebreaks can be further exasperated when environmental conditions are less than optimal. For example, aircraft can't deliver flame-retardant payloads at night (permitting the fire to grow unabated during such time), and aircraft payload delivery accuracy may be diminished due to wind, rain, and/or smoke. These less than favorable environmental conditions impede firefighting efforts and therefore may increase, for example, required equipment, materials, and time necessary to contain the fire and may result in tens, hundreds, or even thousands of additional acres being consumed by the fire.

An improved system and method is needed to fight forest and other types of fires.

SUMMARY

In one embodiment, an artillery shell is disclosed. The artillery shell includes an external surface, a cavity, a fire-retarding material, and a trigger. The cavity is disposed within the external surface. The fire-retarding material is disposed within the cavity. The trigger is configured to release the fire-retarding material.

In another embodiment, a fire-fighting system is disclosed. The fire-fighting system includes a gun and an artillery shell. The artillery shell is configured to be fired out of the gun. The artillery shell includes an external surface, a cavity, a fire-retarding material, and a trigger. The cavity is within the external surface. The fire-retarding material is disposed within the cavity. The trigger is configured to release the fire-retarding material.

In an additional embodiment, a trigger is disclosed. The trigger is configured to mechanically open a shell. The trigger includes an interface, at least one arm, and a device. The interface is configured to connect to the shell. The at least one arm is configured to open the shell. The device comprises a timer, an altimeter, an accelerometer, a global positioning device, a temperature sensor, a pressure sensor, or a distance measuring device which is configured to determine when the at least one arm opens the shell.

In still another embodiment, a method of retarding a fire is disclosed. In one step, an artillery shell is fired out of a gun towards a fire. In another step, a release of fire-retarding material from the artillery shell is triggered in order to retard the fires.

The scope of the present disclosure is defined solely by the appended claims and is not affected by the statements within this summary.

BRIEF DESCRIPTION OF THE DRAWINGS

The disclosure can be better understood with reference to the following drawings and description. The components in the figures are not necessarily to scale, emphasis instead being placed upon illustrating the principles of the disclosure.

DETAILED DESCRIPTION

Figure 1:
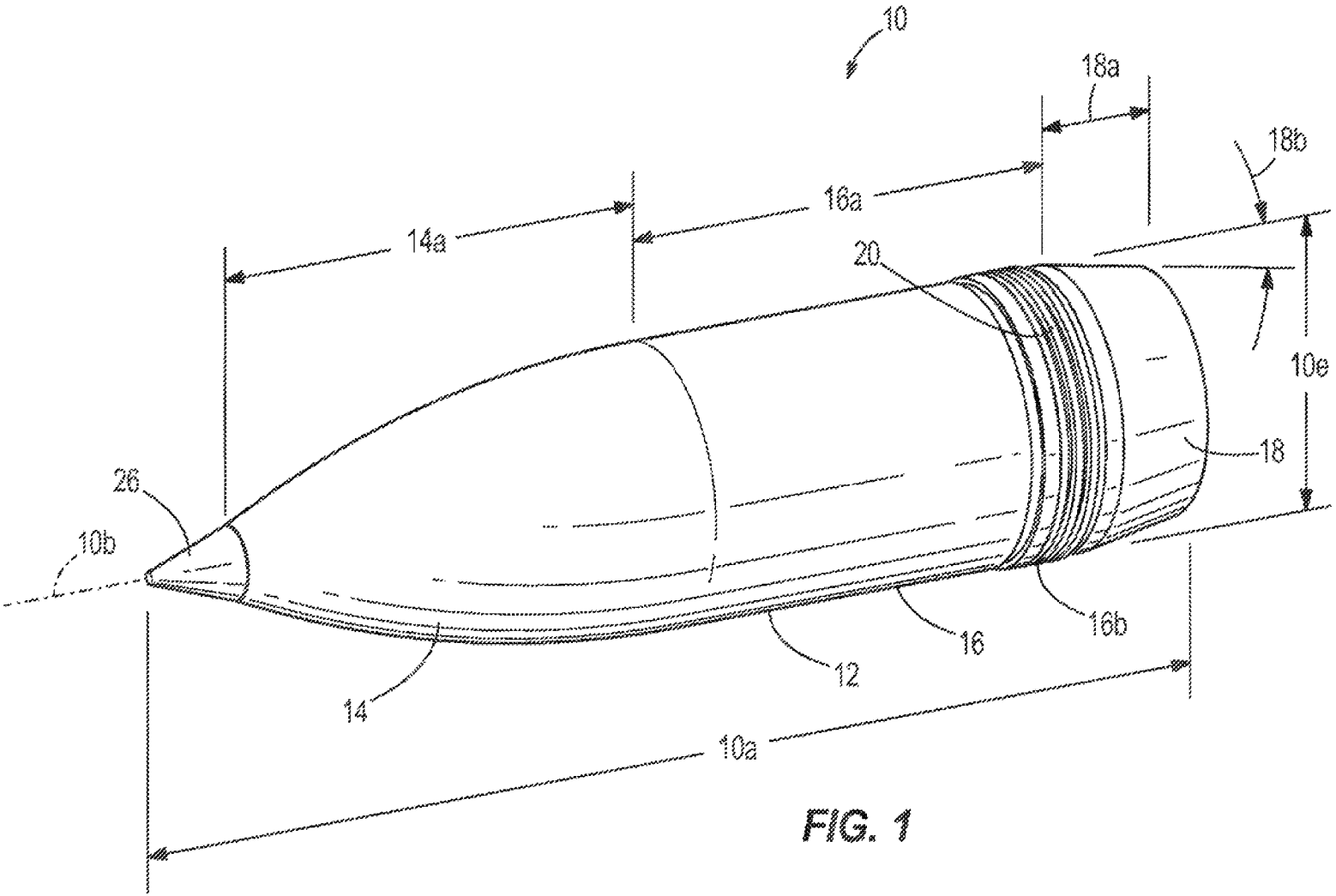
FIG. 1 illustrates a perspective view of one embodiment of an artillery shell.
Figure 2:
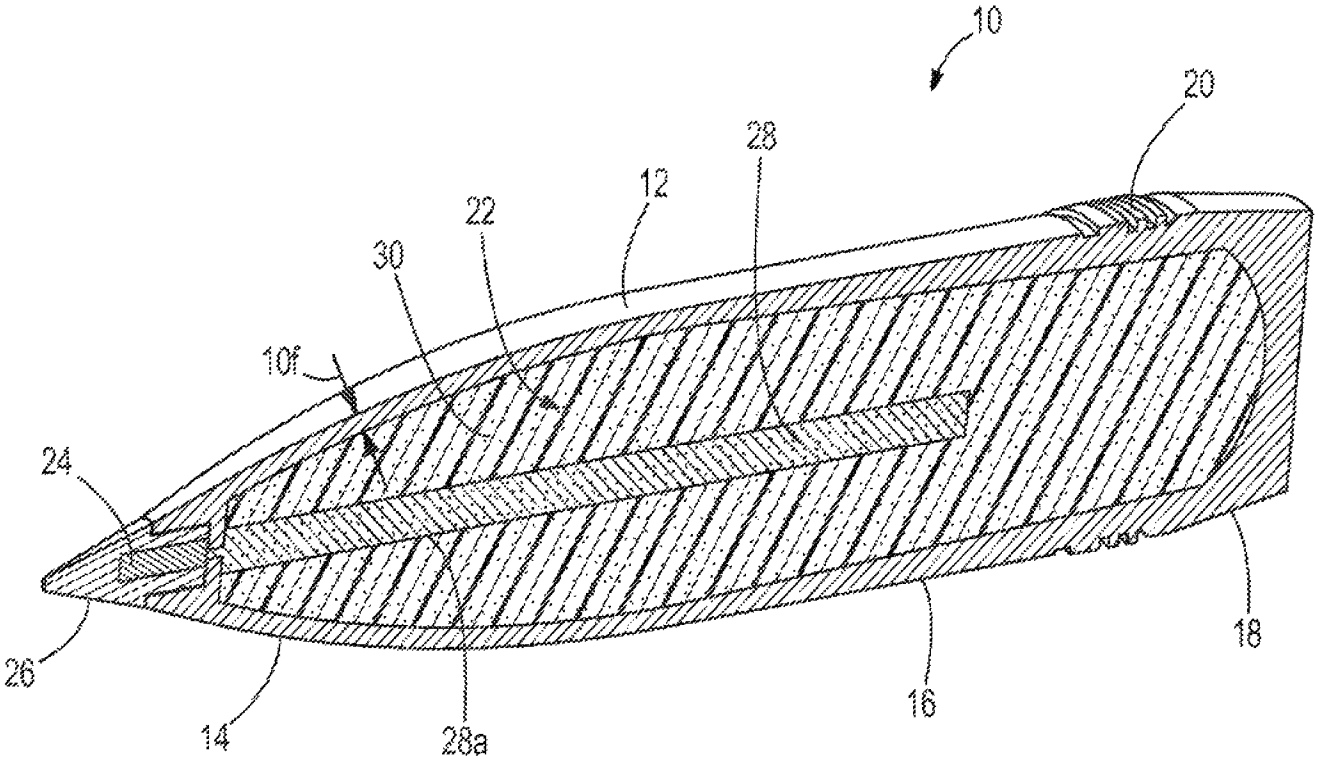
FIG. 2 illustrates a cross-sectional view of the artillery shell of FIG. 1.

FIG. 1 illustrates a perspective view of one embodiment of an artillery shell 10. FIG. 2 illustrates a cross-section view of the artillery shell 10 of FIG. 1. As shown collectively in FIGS. 1 and 2, the artillery shell 10 comprises an external surface 12, a fore-body 14, a mid-body 16, an aft-body 18, driving bands 20, a cavity 22, a trigger 24, a fuse 26, explosive material 28, and a fire-retarding material 30. The artillery shell 10 has an axi-symmetric geometry. The artillery shell 10 comprises a tapered nose section including the fuse 26 and the fore-body 14, a constant diameter mid-body 16, and a linearly tapered aft-body 18. The length 10*a* of the artillery shell 10 ranges from about 600 mm to about 1,200 mm. In other embodiments, the length 10*a* of the artillery shell 10 may vary depending on the required volume of fire-retarding material 30 to be carried within the cavity 22 of the artillery shell 10. The artillery shell 10 can have a diameter 10*e* matching existing 105 mm, 122 mm, 155 mm, or 203 mm caliber shells to fit in existing guns. In other embodiments, the diameter 10*e* of the artillery shell 10 may vary. The external geometry of the artillery shell 10 should correspond to the specifications of the gun from which the artillery shell is fired.

The geometry of the artillery shell 10 is dominated by the outer shell geometry and the required shell thickness 10*f* of the external surface 12 of the artillery shell 10. The shell thickness 10*f* ranges from about 1 mm to about 50 mm. In other embodiments, the shell thickness 10*f* may vary. The shell thickness 10*f* increases monotonically from a smallest thickness at the fore-body 14 through the mid-body 16 to a largest thickness at the aft-body 18. The thickness distribution depends on the material of the external surface 12 of the artillery shell 10 and is selected to ensure that the artillery shell 10 can withstand the external and internal loads the artillery shell 10 endures when fired out of a gun. The external loads on the artillery shell 10 comprise thermal loads caused by air friction at high speeds, hydrostatic loads of the payload in the form of the fire-retarding material 30 due to high accelerations at launch, centrifugal loads of the payload in the form of the fire-retarding material 30 due to spinning of the artillery shell 10, and forces exerted on the grooves 16*b* holding the driving bands 20 caused by friction between the driving bands 20 and the gun barrel at launch. The internal loads on the artillery shell 10 comprise inertial body loads caused by the acceleration of the artillery shell 10 at launch and by spinning of the artillery shell 10. In other embodiments, the external and internal loads on the artillery shell 10 may vary.

In one embodiment, the external surface 12 of the artillery shell 10 may be made of any degrading metal which decomposes in nature in less than ten years or is inert and is not harmful to the environment without decomposition. In this embodiment, the external surface 12 is made of high carbon steel, structural glass, or ceramics having a tensile strength greater than about 200 MP such as Zirconia, Zirconia-toughened Alumina, or Alumina. The artillery shell 10 may be coated with thermal insulator material to reduce the rate of heat transfer from the heated boundary layer adjacent to the surface and the body of the shell. In other embodiments, the external surface 12 of the artillery shell 10 may be made of varying materials. In one embodiment, the external surface 12 of the artillery shell 10 is made of an environmentally safe/friendly material which will degrade in a time period ranging from about 1 month to about 10 years, but at no time before, during, or after its degradation shall it be toxic to the environment. In other embodiments, the external surface 12 of the artillery shell 10 may be made of varying materials having varying rates of degradation. For purposes of this disclosure, the term environmentally safe/friendly is defined as a material that (after being released in the environment): is not physiologically harmful to any type of living organism; does not decay to another material which is physiologically harmful to any type of living organism; and does not create any physically harmful (such as sharp fragments) or aesthetically unpleasant artifacts.

The external geometry of the artillery shell 10 comprises three sections including the fore-body 14, the mid-body 16, and the aft-body 18 that can be changed to form a family of artillery shells 10 with varying payloads of fire-retarding material 30. The overall geometry may be optimized to maximize the amount of fire-retarding material 30 that can be carried in an artillery shell 10 for a given range. Ranges can vary from about 0.10 miles to about 25 miles. In other embodiments, the ranges may vary further. In one embodiment, the fore-body 14, mid-body 16, and the aft-body 18 are constructed as a single part. In other embodiments, the fore-body 14 is threadedly attached to the mid-body 16. The mid-body 16 is threadedly attached to the aft-body 18. In other embodiments, the fore-body 14, the mid-body 16, and the aft-body 18 may be attached to one another through varying attachment mechanisms.

The overall length 10*a* of the artillery shell 10 is driven by the capacity and geometry of the gun that is used to fire the artillery shell 10. The capacity may affect the maximum allowable weight of the artillery shell 10, which then may affect the overall length 10*a*. The distance between the base of the breech and the start of the rifled section of the gun barrel corresponds also to the overall length 10*a* of the artillery shell 10.

The fore-body 14 is an axi-symmetric body of revolution that can have any of the following external profiles: tangent ogive; secant ogive; elliptical; conic; or any spline shape following the cross-sectional area distribution (perpendicular to the longitudinal axis 10*b* of the artillery shell 10) that approximates the area distribution prescribed by the Sears-Haack rule for length 14*a* of fore-body 14. The profile of the fore-body 14 does not converge but rather is truncated. In other embodiments, the fore-body 14 may have varying shapes. In one embodiment, the fuse 26 is threadedly attached to the fore-body 14. In other embodiments, the fuse 26 may be attached to the fore-body 14 using varying attachment mechanisms. In one embodiment, the fore-body 14 has a length 14*a* in a ranging from about of 50 mm to about 500 mm. In other embodiments, the length of the fore-body 14 may vary.

In one embodiment, the external geometry of the mid-body 16 is a constant cross-section cylinder that connects the fore-body 14 and the aft-body 18. The length 16*a* of the mid-body 16 is the difference between the overall length 10*a* of the artillery shell 10 and the respective lengths 14*a* and 18*a* of the fore-body 14 and the aft-body 18. The length 16*a* of the mid-body 16 ranges from about 50 mm to about 750 mm. In other embodiments, the length 16*a* of the mid-body may vary. In other embodiments the mid-body 16 may not be present. The mid-body 16 contains grooves 16*b* (to which driving bands 20 are attached) to act as an interface between the artillery shell 10 and a barrel of a gun from which the artillery shell 10 is fired. The driving bands 20 are made of copper to the specifications of current guns. In other embodiments, the driving bands 20 may be made of varying material and may be attached to the artillery shell 10 in varying manners.

The aft-body 18 is a truncated conical section with a length 18*a* ranging from about 50 mm to about 400 mm and a cone angle 18*b* ranging from about 0 to about 45 degrees. In other embodiments, the length 18*a* and cone angle 18*b* of the aft-body 18 may vary.

The cavity 22 is disposed within the external surface 12. The fire-retarding material 30 is disposed within the cavity 22. The cavity 22 is disposed adjacent to the fuse 26. The explosive material 28 is attached to the artillery shell 10 for fragmenting or opening the artillery shell 10. In one embodiment, the explosive material 28 is comprised of Composition A-5 or any other mixture of RDX (research department explosive is a nitroamine, also referred to as cyclonite, hexogen, cyclotrimethylenetrinitramine or cycltrimethylene trinitramine) and/or HMX (high-melting explosive nitroamine, also referred to as octogen, cyclotetramethylene-tetranitramine, tetrahexamine tetranitramine, or octahydro-1,3,5,7-tetranitro-1,3,5,7-tetrazocine) with Stearic Acid. In other embodiments, the 28 may be made of varying materials. The explosive material 28 may be attached to the artillery shell 10 in varying ways. In one embodiment, the explosive material 28 may be attached within a central tube 28*a* extending in an axial direction along the artillery shell 10. In other embodiments, the explosive material 28 may be attached to the artillery shell 10 using one or more tubes extending along the length of the artillery shell 10, or extending in the circumferential direction of the artillery shell 10. In other embodiments, the explosive material 28 may be attached to the artillery shell 10 using different mechanisms. In additional embodiments, the fuse 26 may contain the explosive material 28, or the explosive material 28 may be used without the fuse 26.

Trigger 24 is connected to fuse 26. The trigger 24 is configured to release the fire-retarding material 30. In one embodiment, the trigger may be connected to the fuse 26 or the explosive material 28 for determining when the fuse 26 detonates the explosive material 28, or for determining when the fuse 26 or the explosive material 28 explodes. Detonation of explosive material 28 may fragment or open the external surface 12 of the artillery shell 10 to release the fire-retarding material 30 out of the cavity 22 of the artillery shell 10. In another embodiment, the trigger 24 may release the fire-retarding material 30 using a mechanical device without the use of explosive material 28 or the fuse 26. In one embodiment, the fuse 26 comprises the trigger 24, a detonator, and a booster. In other embodiments, the fuse 26 may vary. In one embodiment, the trigger 24 comprises one or a combination of the following: a timer, an altimeter, an accelerometer, a global positioning device, a temperature sensor, a pressure sensor, a distance measuring device, or a mechanical device. In other embodiments, the trigger 24 may vary. For instance, in one embodiment, the trigger 24 may comprise an external computer in wireless communication with the fuse 26. Typically, the trigger 24 will release the fire-retarding material 30 in mid-air after the artillery shell 10 has been fired out of a gun and is proximate a forest fire, a nuclear plant fire, a chemical fire, or another type of fire for which the fire-retarding material 30 is being used to retard, reduce, or extinguish.

In one embodiment, the fire-retarding material 30 has a density ranging from about 100 kg/m$^3$ to about 1,200 kg/m$^3$. In other embodiments, the density may vary. The fire-retarding material 30 may comprise a long-term retardant such as those disclosed at http://www.fs.fed.us/nn/fire/documents/qp1_r_r.pdf. These may include, for example, Phos-Chek D75-R, Phos-Chek D75-F, Phos-Chek P100-F, Phos-Chek MVP-F, Phos-Chek 259-F, Phos-Chek LC-95A-R, Phos-Chek LC-95A-F, or PhosChek LC-95-W.

The fire-retarding material 30 may comprise a class A foam such as those disclosed at http://www.fs.fed.us/rm/fire/wfcs/documents/qp1_fm1_pdf. These may include, for example, Tyco Silv-Ex, FireFoam 103B, Phos-Chek WD881, FireFoam 104, Angus ForExpan S, Pyrocap B-136, Phos-Check WD881C, National Foam KnockDown, Summit FlameOut, Angus Hi-Combat A, Buckeye Platinum Class A Foam, Solberg Fire-Brake 3150A, First Response, Tyco Silv-Ex Plus Class A, 1% Bushmaster A Class Foam, or Phos-Chek WD881A.

The fire-retarding material 30 may comprise a water enhancer such as those disclosed at http://www.fs.fed.us/rm/fire/wfcs/documents/qp1_we_pdf. These may include, for example, Chemdal Aqua Shield 100, Phos-Chek AquaGel-K, FireOut Ice, Barricade II, Thermo-Gel 200L, Thermo-Gel SOOP, Wildfire AFG Firewall II, BioCentral Blazetamer 380, GelTech Firelce, Phos-Chek Insul-8, or Thermo-Gel 300L. In other embodiments, the fire-retarding material 30 may vary.

Figure 3:
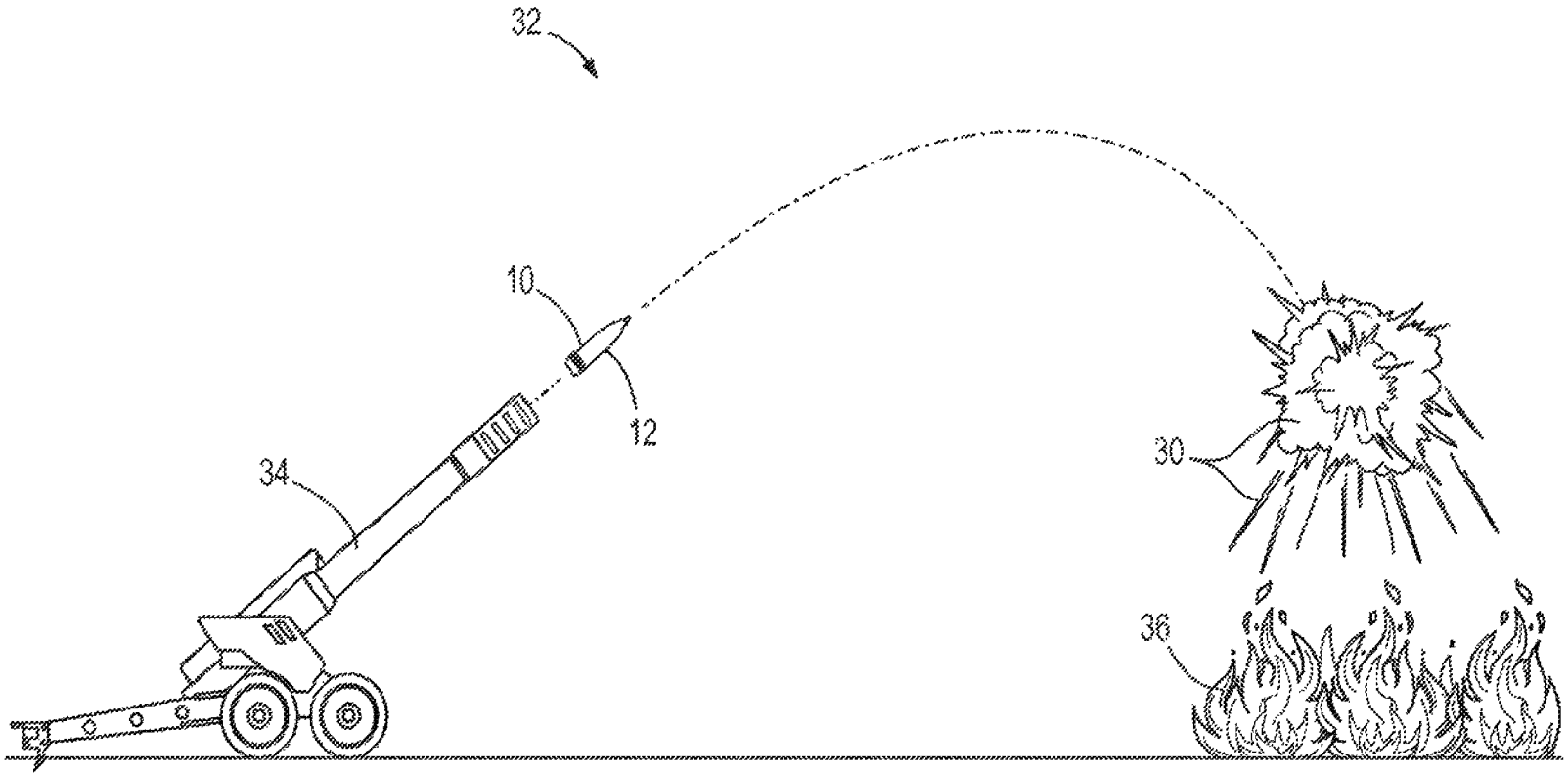
FIG. 3 illustrates a side view of one embodiment of a fire-fighting system comprising the artillery shell of FIG. 1 being shot out of a gun towards a fire.

FIG. 3 illustrates a side view of one embodiment of a fire-fighting system 32 comprising the artillery shell 10 of FIG. 1 being shot out of a gun 34 towards a fire 36. For purposes of this disclosure the terms "towards" and "toward" (when used to describe a location relative to a fire), include in-front of an advancing fire, adjacent to an advancing fire, over the fire, and/or on the fire. The gun 34 may comprise a M777, medium 155 mm field howitzer developed and manufactured by BAE Systems Land Armament, including all variations. In another embodiment, the gun 34 may comprise a Haubits Fh77, medium155 mm field Howitzer, developed and manufactured by Bofors, including all variations. In still another embodiment, the gun 34 may comprise a M109 Paladin, self-propelled medium 155 mm Howitzer manufactured by BAE Systems Land Armament, including all variations. In yet another embodiment, the gun 34 may comprise a 152 mm Howitzer 2A65, medium 152 mm Howitzer developed by multiple design bureaus with the former USSR (now the Russian federation), including all variations. In other embodiments, the gun 34 may vary. The fire 36 may comprise a forest fire, a nuclear plant fire, a chemical fire, or another type of fire.

After the artillery shell 10 is shot out of the gun 34 towards the fire 36, the trigger 24 (shown in FIG. 2) triggers the fuse 26 (shown in FIG. 2) to detonate the explosive material 28 (shown in FIG. 2) thereby breaking-apart the external surface 12 of the artillery shell 10 thereby releasing the fire-retarding material 30 out of the cavity 22 (shown in FIG. 2) of the artillery shell 10 into the fire 36 to retard, reduce, or extinguish the fire 36. Ideally the fire-retarding material 30 is released in mid-air above the fire 36 and achieves a coverage ranging from about 1 gallon/100 ft$^2$ to about 6 gallons/100 ft$^2$. In another embodiment, the fire-retarding material 30 achieves a coverage larger than 6 gallons/100 ft$^2$. In still other embodiments, the fire-retarding material 30 achieves varying coverage levels. In still another embodiment, the trigger 24 may release the fire-retarding material 30 without using explosive material 28 or the fuse 26.

This retarding of the fire can be achieved either by releasing the fire-retarding material 30 directly on the fire 36, or by releasing the fire-retarding material 30 ahead of the advancing fire 36, or by a combination thereof. For purposes of this disclosure, the term "retard" or "retarding" is defined as slowing, diminishing, hindering, delaying, impeding, or reducing. Moreover, the retarding of the fire 36 can be achieved by firing a concentration barrage, a creeping barrage, rolling barrage, or a block barrage. The gun 34 delivers the fire-retarding material 30 with high accuracy, at a high rate of delivery, at a reduced cost over typical fire-fighting methods such as airplane or helicopter release or ground-based fire-fighters. The fire-retarding material 30 may be delivered continuously or intermittently for long durations, regardless of darkness, weather conditions, or intensity of the fire with reduced risk to those fighting the fire 36. Some guns 34 may deliver the fire-retarding material 30 within 15 feet of a target at a 15 mile range. In other embodiments, the range of the artillery shells 10 fired by the guns 34 and the accuracy of the guns 34, which delivers fire-retarding material 30, may vary depending on the particular artillery shells 10 and guns 34 used.

The following table of simulation results for a fire having an initial size of 28 acres (column 2) shows advantages in using artillery shells 10 (rows 2 to 4) to delivery fire-retarding material 30 over using aircraft (defined herein as any manned or unmanned vehicle, such as an airplane, helicopter or balloon, which travels through the air) to deliver the fire-retarding material (row 5). These advantages include less acres of land burnt (column 3), less time to put out the fire (column 4), and less volume of fire-retarding material 30 required to put out the fire (column 5).

| ROW 1 | COLUMN 1 DELIVERY METHOD | COLUMN 2 FIRE INITIAL SIZE (ACRES) | COLUMN 3 AREA BURNT (ACRES) | COLUMN 4 TOTAL TIME (HOURS) | COLUMN 5 VOLUME OF RETARDANT DELIVERED (GALLONS) |
|---|---|---|---|---|---|
| ROW 2 | SHELL (1.57 GAL) | 28 | 45 | 3.2 | 4,333 |
| ROW 3 | SHELL (2.00 GAL) | 28 | 42 | 3.0 | 4,224 |
| ROW 4 | SHELL (3.00 GAL) | 28 | 39 | 2.6 | 4,990 |
| ROW 5 | HELICOPTER | 28 | 100 | 7.6 | 6,469 |

The following table of simulation results for a fire having an initial size of 883 acres (column 2) shows advantages in using artillery shells 10 (rows 2 to 4) to delivery fire-retarding material 30 over using aircraft to deliver the fire-retarding material (rows 5 to 6). These advantages include less acres of land burnt (column 3), less time to put out the fire (column 4), and less volume of fire-retarding material 30 required to put out the fire (column 5).

| ROW 1 | COLUMN 1 DELIVERY METHOD | COLUMN 2 FIRE INITIAL SIZE (ACRES) | COLUMN 3 AREA BURNT (ACRES) | COLUMN 4 TOTAL TIME (HOURS) | COLUMN 5 VOLUME OF RETARDANT DELIVERED (GALLONS) |
|---|---|---|---|---|---|
| ROW 2 | SHELL (1.57 GAL) | 883 | 1173 | 5.9 | 220,000 |
| ROW 3 | SHELL (2.00 GAL) | 883 | 1144 | 5.4 | 218,000 |
| ROW 4 | SHELL (3.00 GAL) | 883 | 1103 | 5.9 | 214,000 |
| ROW 5 | HELICOPTER | 883 | 2214 | 22.7 | 303,000 |
| ROW 6 | HELICOPTER WTH 8 HRS DOWN TIME | 883 | 3130 | 34.3 | 360,000 |

The results of the above tables were simulated by Applicant based on information available at NWCG Incident Response Pocket Guide http://www.nwcg.gov/pms/pubs/nfes1077/nfes1077.pdf.

After the artillery shell 10 breaks apart, the fragments of the artillery shell 10 are environmentally friendly and degrade at a rate sufficient to avoid harm to the environment. In one embodiment, the exploded, fragmented, opened, or broken-apart artillery shell 10 may degrade in a time period ranging from about 1 month to about 10 years, but at no time before, during, or after its degradation shall it be toxic to the environment. In other embodiments, the exploded, fragmented, opened, or broken-apart artillery shell 10 may degrade at varying rates, or degradation may not be necessary as the material will be environmentally inert.

Figure 4:
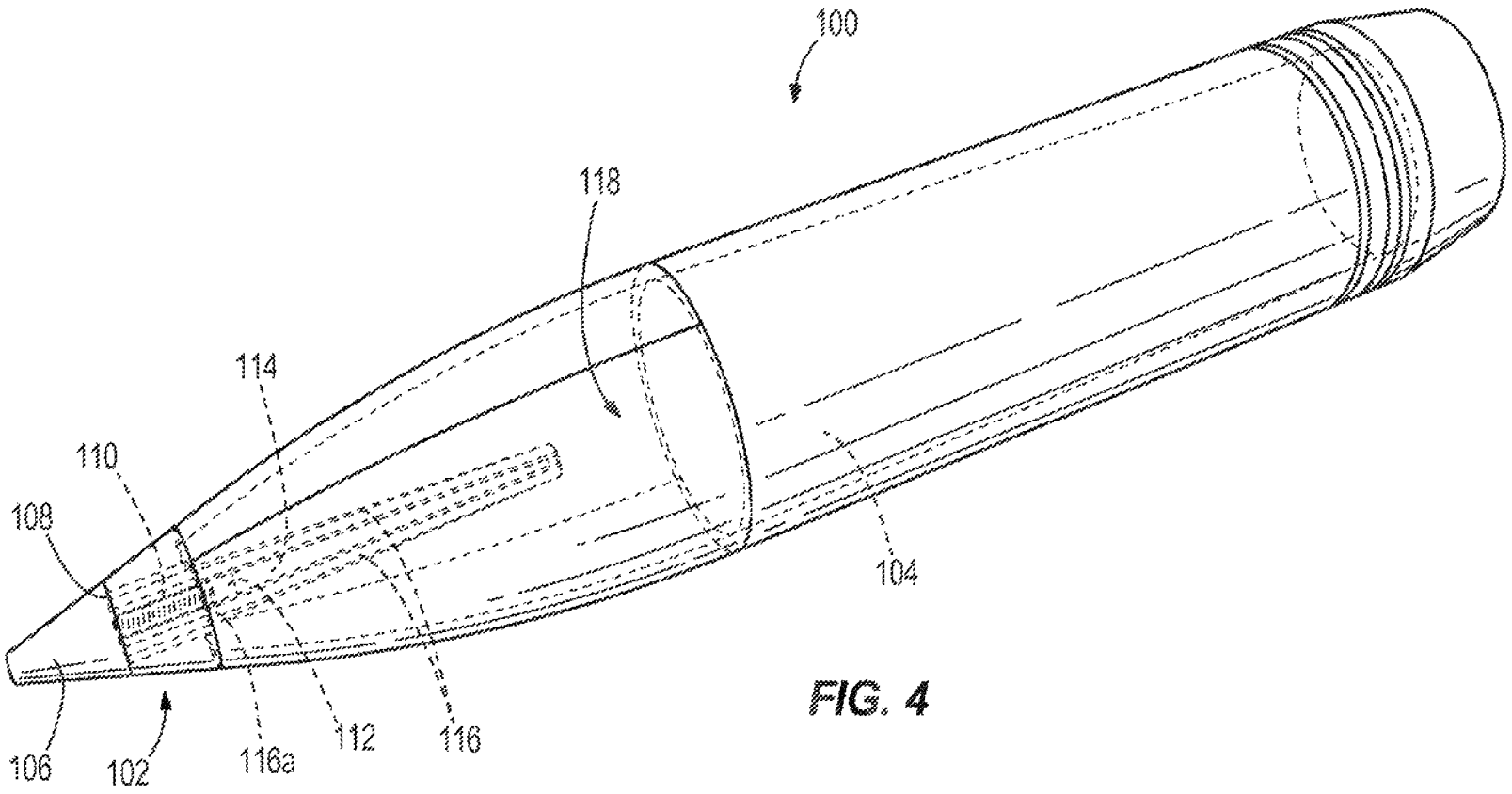
FIG. 4 illustrates a perspective view of one embodiment of an artillery shell with a mechanical device disposed in the artillery shell in a retracted position.
Figure 5:
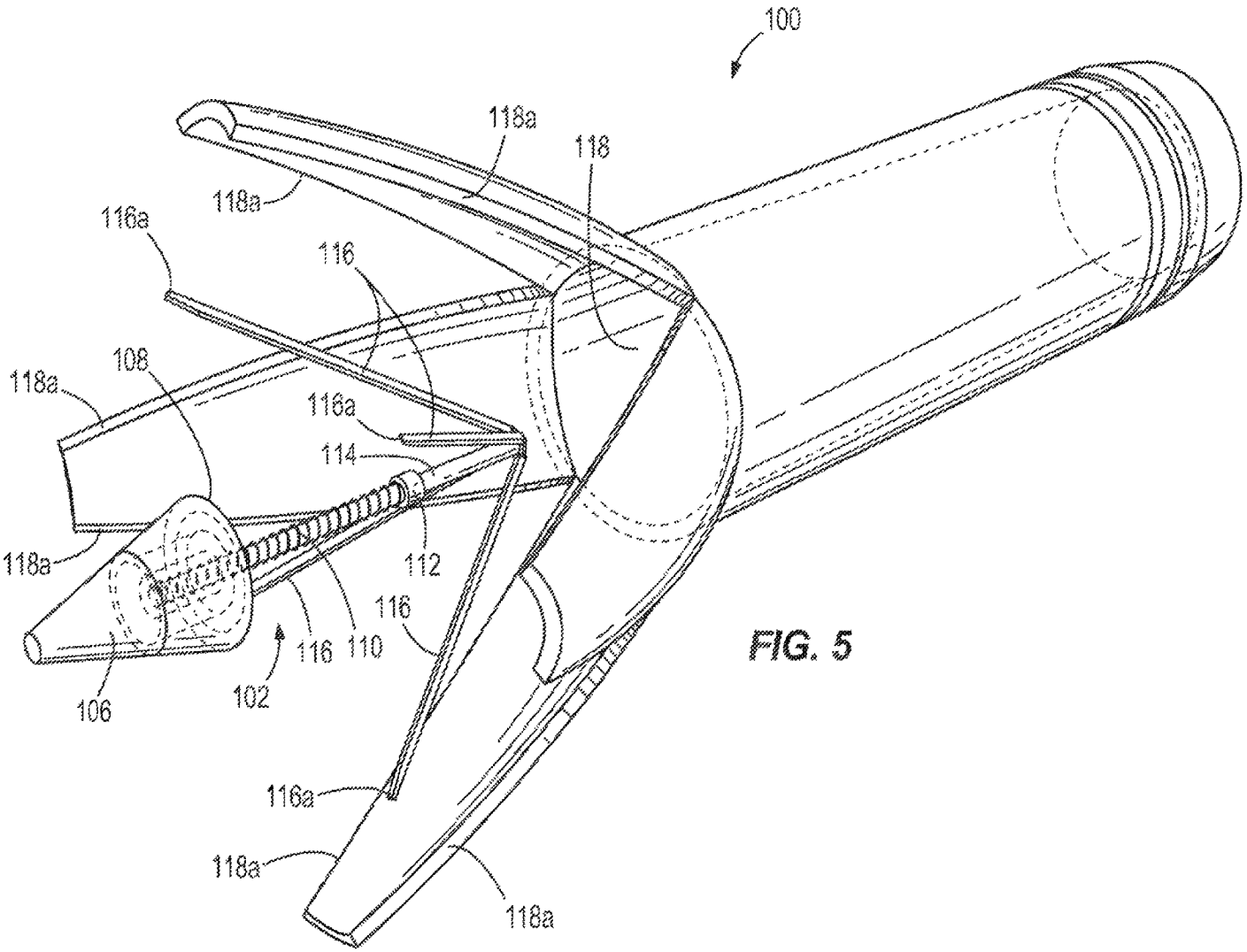
FIG. 5 illustrates the artillery shell of FIG. 4 with the mechanical device in an extended position.
Figure 6:
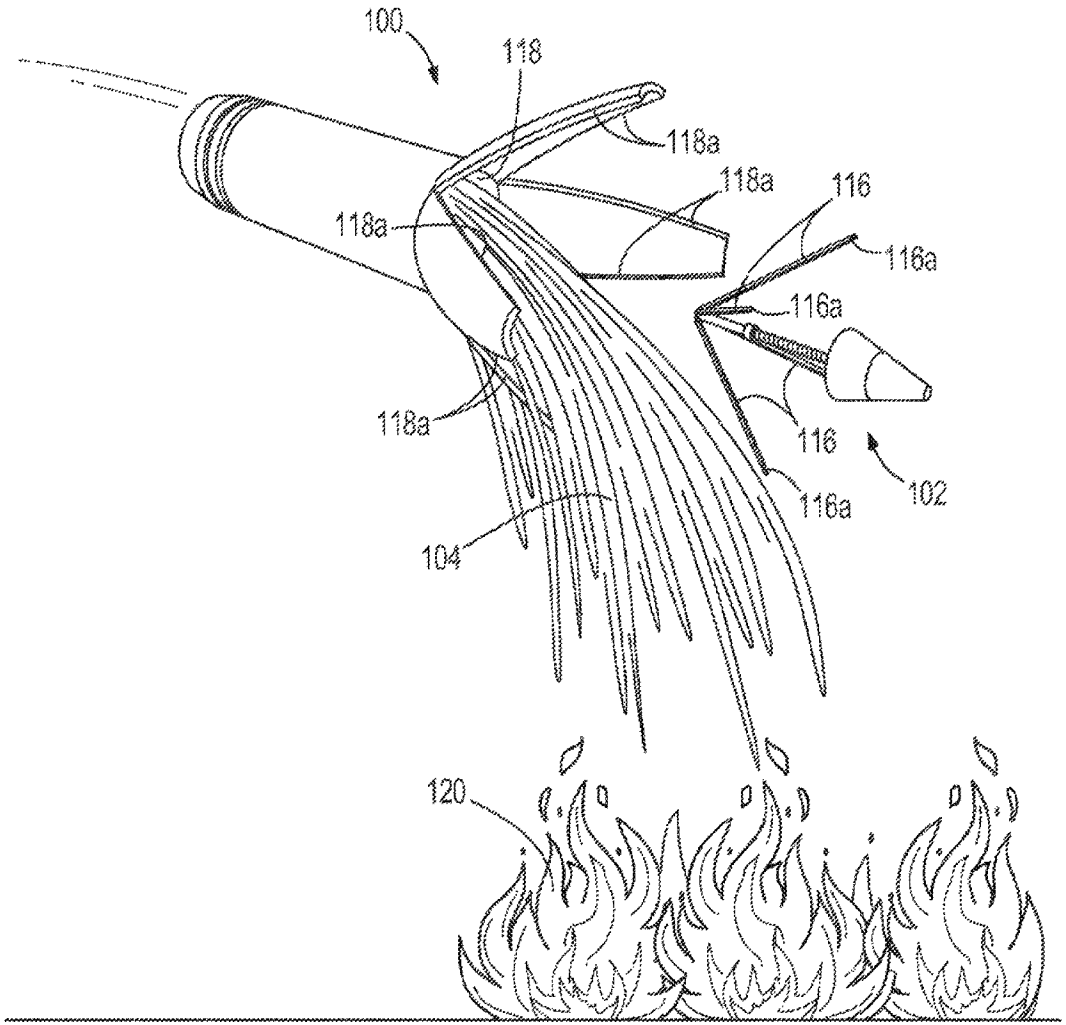
FIG. 6 illustrates the artillery shell of FIG. 5 having been fragmented or opened by the mechanical device releasing fire-retarding material stored within the mechanical device.

FIG. 4 illustrates a perspective view of one embodiment of an artillery shell 100 with a mechanical device 102 disposed in the artillery shell 100 in a retracted position. FIG. 5 illustrates the artillery shell 100 of FIG. 4 with the mechanical device 102 in an extended position. FIG. 6 illustrates the artillery shell 100 of FIG. 5 having been fragmented or opened by the mechanical device 102 releasing fire-retarding material 104 stored within the mechanical device 102.

As shown collectively in FIGS. 4, 5, and 6, the mechanical device 102 comprises a trigger 106, an interface 108, a spring 110, a sliding device 112, a rod 114, and arms 116. In other embodiments, the mechanical device 102 may comprise any number of the above-recited components or one or more of the components may be missing. When the mechanical device 102 is in the retracted position shown in FIG. 4, the trigger 106 is disposed outside of and against the artillery shell 100. The trigger 106 is attached to the rod 114. The trigger 106 is configured to determine when the mechanical device 102 fragments or opens the artillery shell 100 thereby releasing the fire-retarding material 104. In one embodiment, the trigger 106 comprises a device comprising one or a combination of the following: a timer, an altimeter, an accelerometer, a global positioning device, a temperature sensor, a pressure sensor, or a distance measuring device. In other embodiments, the trigger 106 may vary. The interface 108, which is also attached to the rod 114, is threadedly attached to and within a cavity 118 of the artillery shell 100 when the mechanical device 102 is in the state shown in FIG. 4. In other embodiments, the interface 108 may be attached to the cavity 118 of the artillery shell 100 using varying mechanisms such as fasteners. In the state shown in FIG. 4, the spring 110, disposed over the rod 114, is compressed and attached between the trigger 106 and the sliding device 112. The sliding device 112 is disposed over the rod 114 in a raised position. The arms 116, pivotally attached to the rod 114, are disposed in a retracted position within the cavity 118 of the artillery shell 100 with the tips 116*a* of the arms 116 disposed integrally within seams 118*a* (best shown in FIG. 5) of the cavity 118 of the artillery shell 100.

As shown in FIG. 5, when the trigger 106 triggers the mechanical device 102 to extend to fragment or open the artillery shell 100, the trigger 106 releases the spring 110. Upon release, the spring 110 extends forcing the sliding device 112 to travel down the rod 114. As the sliding device 112 travels down the rod 114, the sliding device 112 forces the arms 116 to pivot and extend outwardly so that the tips 116*a* of the arms 116 push against the seams 118*a* of the cavity 118 of the artillery shell 100. This force of the tips 116*a* of the arms 116 against the seams 118*a* of the cavity 118 of the artillery shell 100 may cause the artillery shell 100 to begin fragmenting or opening. The arms 116 may be made of high-strength heat treated steel and the tips 116*a* of the arms may be sharp. When the arms 116 are extended outwardly, the aerodynamically shaped tips 116*a* of the arms 116 may be exposed to free stream flow at high speed which may generate large aerodynamic forces which may be transmitted to the arms 116 and ultimately to the seams 118*a* of the cavity 118 of the artillery shell 100.

As shown in FIG. 6, due to the tips 116*a* of the arms 116 pushing against seams 118*a* of the cavity 118 of the artillery shell 100, the artillery shell 100 may fragment or open along the seams 118*a* thereby releasing the fire-retarding material 104 stored within the cavity 118 of the artillery shell 100 which may then retard fire 120. It is noted that while the artillery shell 100 is beginning to fragment or to open the artillery shell 100 may rapidly decelerate due to the drag acting on the deployed arms 116. While the artillery shell 100 is fracturing or opening, the fractures or openings in the seams 118*a* may grow and allow for a low energy, yet rapid, fragmentation or opening of the artillery shell 100.

In such manner, a mechanical device 102 may be used to fragment or open the artillery shell 100 without the use of a fuse or explosives thereby reducing cost and manufacture time. The heat and impulse associated with explosives may be absent which allows delivery of sensitive organic material with lower average fragment energy. In other embodiments, the mechanical device 102 may vary. In still other embodiments, the cavity 118 of the artillery shell 100 may contain varying types of materials other than fire-retarding material 104 such as seeds, fertilizer, a bomb, or any type of material to be delivered from the artillery shell 100.

Figure 7:
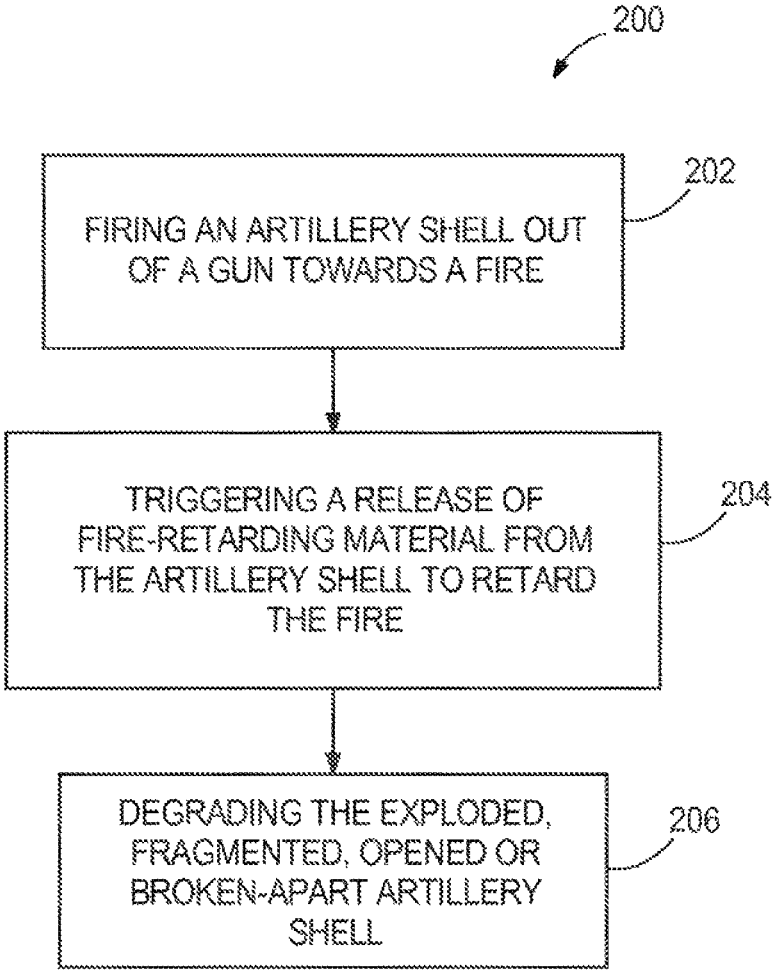
FIG. 7 is a flowchart showing one embodiment of a method of retarding a fire.

FIG. 7 is a flowchart showing one embodiment of a method 200 of retarding a fire. The method 200 may utilize the artillery shell 10 of FIG. 1 or the artillery shell 100 of FIG. 4 in conjunction with the fire-fighting system 32 of FIG. 3. In step 202, an artillery shell is fired out of a gun towards a fire. The fire may comprise a forest fire, a nuclear plant fire, a chemical fire, or another type of fire. In step 204, a release of fire-retarding material from the artillery shell is triggered (i.e. triggering) to retard the fire. In one embodiment, the triggering determines when a fuse detonates explosive material attached to the artillery shell to break-apart the artillery shell thereby releasing fire-retarding material out of a cavity of the artillery shell toward the fire to retard the fire and/or retard the spread of the fire. The triggering may set off the fuse to detonate the explosive material to break-apart the artillery shell either at a pre-determined time, at a pre-determined altitude, at a pre-determined acceleration, at a pre-determined location, at a pre-determined temperature, at a pre-determined pressure, or at a pre-determined distance. In other embodiments, the triggering may set off the fuse to detonate the explosive material to break-apart the artillery shell using varying triggers or mechanisms. In another embodiment, the triggering may trigger the artillery shell to release the fire-retarding material from the artillery shell using a mechanical device or other type of device without using explosive material or a fuse. In still another embodiment, the triggering may trigger either the fuse by itself or the explosive material by itself to detonate to break-apart the artillery shell. The retarding of the fire can be achieved either by releasing the fire-retarding material directly on the fire, or by releasing the fire-retarding material ahead of the fire to cut it off from spreading, or by a combination thereof. Moreover, the fire can be retarded by firing a concentration barrage, a creeping barrage, a rolling barrage, or a block barrage.

In step 206, the exploded, fragmented, opened, or broken-apart artillery shell degrades in a time period ranging from about 1 month to about 10 years, but at no time before, during, or after its degradation shall it be toxic to the environment. In other embodiments, the exploded, fragmented, opened, or broken-apart artillery shell may degrade at varying rates. In other embodiments, one or more steps of the method 200 may vary in substance or in order, one or more steps may not be followed, or one or more additional steps may be added.

Contrary to previous methods and systems for fighting fire (which relied on aircraft personal to deliver a fire retardant to a fire site), the method and system for fighting fire as described herein, enables ground personal to remain at a safe distance away from the fire, thus reducing risk of injury to the ground personal.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure (the term "embodiment" may be used interchangeably with the term "aspect"). This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true scope of the subject matter described herein. Furthermore, it is to be understood that the disclosure is defined by the appended claims. Accordingly, the disclosure is not to be restricted except in light of the appended claims and their equivalents.

The invention claimed is:

1. An artillery shell comprising:

a fore-body, a mid-body, and an aft-body defined by an external surface and having a shell thickness, wherein the shell thickness increases from a first thickness at the fore-body to a second thickness at the mid-body and further increases to a third thickness at the aft-body;

a cavity disposed within the external surface;

a fire-retarding material disposed within the cavity; and a trigger configured to release the fire-retarding material.

2. The artillery shell of claim 1, further comprising a fuse or explosive material.

3. The artillery shell of claim 2, wherein the trigger is connected to the fuse or the explosive material for determining when the fuse or the explosive material explodes.

4. The artillery shell of claim 1, wherein the trigger comprises one or a combination of the following: a timer, an altimeter, an accelerometer, a global positioning system device, a temperature sensor, a pressure sensor, a distance measuring device, or a mechanical device.

5. The artillery shell of claim 1, wherein the fire-retarding material comprises at least one of a long-term retardant, a class A foam, and a water enhancer.

6. The artillery shell of claim 1, wherein the external surface comprises at least one of: high carbon steel, structural glass, Zirconia, Zirconia-toughened Alumina, Alumina, or ceramics having a tensile strength greater than 200 MP.

7. The artillery shell of claim 1, wherein the fore-body is axi-symmetric, the mid-body has a constant cross-section, and the aft-body is partially conical.

8. The artillery shell of claim 1, further comprising driving bands attached to grooves of the external surface of the shell.

9. A fire-fighting system comprising:

a gun; and an artillery shell which is configured to be fired out of the gun, wherein the artillery shell comprises:

a fore-body, a mid-body, and an aft-body defined by an external surface and having a shell thickness, wherein the shell thickness increases from a first thickness at the fore-body to a second thickness at the mid-body and further increases to a third thickness at the aft-body;

a cavity disposed within the external surface;

a fire-retarding material disposed within the cavity; and a trigger configured to release the fire-retarding material.

10. The fire-fighting system of claim 9, further comprising a fuse or explosive material.

11. The fire-fighting system of claim 10, wherein the trigger is connected to the fuse or the explosive material for determining when the fuse or the explosive material explodes.

12. The fire-fighting system of claim 9, wherein the trigger comprises either one or a combination of: a timer, an altimeter, an accelerometer, a global positioning system device, a temperature sensor, a pressure sensor, a distance measuring device, or a mechanical device.

13. The fire-fighting system of claim 9, wherein the external surface is axi-symmetric.

14. The fire-fighting system of claim 9, wherein the artillery shell further comprises driving bands disposed between and against the external surface of the artillery shell and the gun.

15. The fire-fighting system of claim 9, wherein the external surface of the artillery shell comprises at least one of: high carbon steel, structural glass, Zirconia, Zirconia-toughened Alumina, Alumina, or ceramics having a tensile strength greater than 200 MP.

16. The artillery shell of claim 1, wherein the external surface comprises a secant ogive.

17. The artillery shell of claim 1, wherein the external surface comprises a tangent ogive.

18. The artillery shell of claim 2, wherein the fuse is threadedly attached to the fore-body.

19. The artillery shell of claim 8, wherein the driving bands comprise copper.

20. The artillery shell of claim 3, wherein the explosive material is surrounded by the fire-retarding material.

* * * * *